US009485588B2

(12) United States Patent
Haho et al.

(10) Patent No.: US 9,485,588 B2
(45) Date of Patent: Nov. 1, 2016

(54) MAPPING SYSTEM AND METHOD

(71) Applicant: Qlu Oy, Oulu (FI)

(72) Inventors: Mikko Haho, Kempele (FI); Tapio Rautio, Haukipudas (FI); Ville Daniel Kivela, Oulu (FI)

(73) Assignee: Qlu Oy, Oulu (FI)

( * ) Notice: Subject to any disclaimer, the term of this patent is extended or adjusted under 35 U.S.C. 154(b) by 163 days.

(21) Appl. No.: 14/619,240

(22) Filed: Feb. 11, 2015

(65) Prior Publication Data

US 2015/0230031 A1 Aug. 13, 2015

(30) Foreign Application Priority Data

Feb. 13, 2014 (FI) ..... 20145144

(51) Int. Cl.
*H04R 25/00* (2006.01)
*H04R 27/00* (2006.01)

(52) U.S. Cl.
CPC ..... *H04R 25/30* (2013.01); *H04R 25/556* (2013.01); *H04R 25/558* (2013.01); *H04R 27/00* (2013.01); *H04R 25/554* (2013.01); *H04R 2225/41* (2013.01); *H04R 2460/07* (2013.01); *H04R 2499/11* (2013.01)

(58) Field of Classification Search
CPC ..... H04R 25/30; H04R 25/40; H04R 25/43; H04R 25/552; H04R 25/554; H04R 25/556; H04R 25/558; H04R 2225/41; H04R 2460/07; H04R 2499/11; H04B 5/0025
USPC ..... 381/58, 60, 23.1, 312, 315, 331; 455/41.1, 67.11, 550.1; 379/52, 430, 379/443
See application file for complete search history.

(56) References Cited

U.S. PATENT DOCUMENTS 9,065,929 B2 * 6/2015 Chen ..... H04M 1/72591
9,307,331 B2 * 4/2016 Pedersen ..... H04R 25/407
2006/0179018 A1 8/2006 Messmer et al.
2006/0182294 A1 8/2006 Grasbon et al.
2010/0054185 A1 3/2010 Kaneko et al.
2013/0109310 A1 5/2013 Mine et al.
2015/0281852 A1 * 10/2015 Sacha ..... H04R 25/30 381/331

FOREIGN PATENT DOCUMENTS

GB 2 413 458 10/2005
GB 2476675 7/2011
JP 2007288515 11/2007

OTHER PUBLICATIONS

Finnish Patent and Registration Office Search Report for corresponding Patent Application No. 20145144, mailed Oct. 9, 2014.
Finnish Patent and Registration Office, Search Report for Corresponding Patent Application No. 20145144; mailed Oct. 9, 2014; 1 page.
European Patent Office; Search Report for Corresponding European Patent Application No. EP 15 15 3878; Dated Apr. 17, 2015; Munich.

* cited by examiner

*Primary Examiner* — Huyen D Le
(74) *Attorney, Agent, or Firm* — Duane Morris LLP

(57) ABSTRACT

A mapping system comprises a sensor unit which is mobile and receives magnetic audio frequency transmission from a site and positioning data with respect to the site to be mapped. A processing unit is operationally coupled with the sensor unit and determines at least one parameter of the magnetic transmission, forms positions of the sensor unit on the basis of positioning data, associates positions and the at least one parameter together, forms a quality map graphically showing a distribution associated with the at least one parameter with respect to positions on the site and outputs said quality map.

10 Claims, 3 Drawing Sheets

MAPPING SYSTEM AND METHOD

FIELD

The invention relates to a mapping system and a mapping method.

BACKGROUND

Buildings, installations and institutions which have public addressing systems have often also an audio frequency induction loop-system (AFILS). The AFILS system transfers an audio signal through a magnetic coupling to a pick-up coil which can also be called a t-coil, a telecoil or a telephone coil of a hearing aid. The hearing aid, in turn, converts the magnetic signal back into the audio signal of the original information such that the user of the hearing aid can hear the audio signal.

Although the AFILS system is adjusted to provide the user of the hearing aid with good quality audio signals, the adjustment doesn't guarantee a satisfactory overall listening experience to a user of a hearing aid, because the audio signal transfer is susceptible to disturbance and large quality variation in reality. As a result, when a person with a hearing aid comes to a venue such as an auditorium, a concert hall or a church, he/she may notice that the quality of the audio signal is poor in the location of the venue where he/she is prepared to stay. As a result, he/she may start to search for a good place without knowing if he/she can find it at all. Hence, there is a need for improvement.

BRIEF DESCRIPTION

An object of the present invention is to provide a mapping system and a mapping method. The objects of the invention are achieved by the mapping system of independent claim 1.

According to another aspect of the present invention, there is provided a mapping method in claim 10.

The preferred embodiments of the invention are disclosed in the dependent claims.

The invention provides advantages. Mapping the whole site properly makes the measurement and adjustment accurate. By storing the result of the mapping in a database where it is available to a user of a hearing aid makes it possible for the user to select a place at the site where the hearing conditions are good or satisfactory for him/her.

LIST OF THE DRAWINGS

In the following the invention will be described in greater detail by means of preferred embodiments with reference to the attached drawings, in which FIGS. 1 and 2 illustrate examples of a mapping system;

DESCRIPTION OF EMBODIMENTS

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

It should be noted that while Figures illustrate various embodiments, they are simplified diagrams that only show some structures and/or functional entities. The connections shown in these Figures may refer to logical or physical connections. Interfaces between the various elements may be implemented with suitable interface technologies. It is apparent to a person skilled in the art that the described apparatuses may also comprise other functions and structures. Therefore, they need not be discussed in more detail here. Although separate single entities have been depicted, different parts may be implemented in one or more physical or logical entities.

Figure 1:
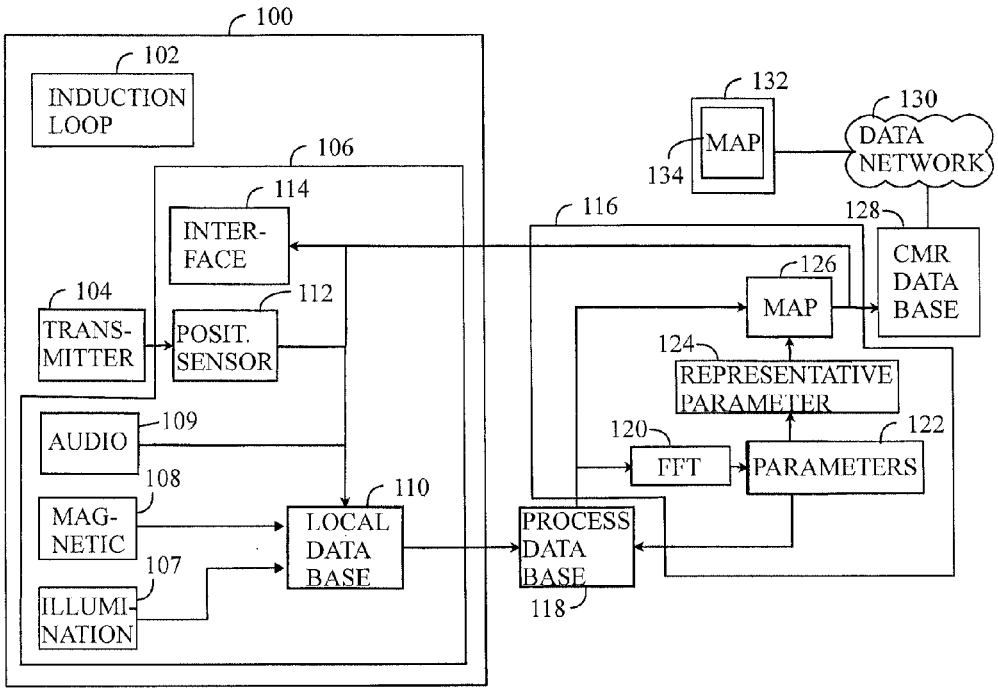

FIG. 1 shows block diagram of a mapping system of a service provider. A site 100 which may be a venue such as an auditorium, a school, a sports hall, a railway station, an airport, a hospital, a concert hall, a church or the like may have at least one transmitter 102 of an audio frequency induction loop-system (AFILS) which converts an audio signal such as sound, speech or music of a performer or a machine into a magnetic signal for transmission. The audio frequencies range from about 20 Hz to 20,000 Hz and sounds of the audio frequencies are considered audible to a human being. However, the band of the AFILS system is often narrower than the full audio range. Basically, the AFILS system comprises a microphone, an amplifier and an induction loop which transmits the information of the audio signal input to the microphone or other connector as a magnetic signal. The AFILS system may provide at least one test signal to be measured with the mapping system.

The site 100 may have at least one positioning transmitter 104 which transmit position related database on which the place of reception of the data can be determined. The at least one positioning transmitter 104 may be a base station or the like. The service provider of the mapping system may place the at least one positioning transmitter 104 at the site 100 in order to perform the mapping. After the mapping is done, the service provider may remove the at least one positioning transmitter 104 from the site 100 and possibly use it at a new site 100 for a new mapping.

A sensor unit 106 of the mapping system receives magnetic audio frequency transmission from the transmitter 102 at the site 100 which is mapped. The sensor unit 106 also receives positioning data which is related to the site 100 to be mapped. The sensor unit 106 is mobile and thus it may be moved on the site 100 while its place can be determined in each position where it takes a sample of the test signal and/or noise signal. The sensor unit 106 may be moved by a person or it may move automatically.

The sensor unit 106 comprises a measurement receiver 108 which comprises a receiver coil similar to a pick-up coil of a hearing aid. The receiver 108 receives magnetic signals on the basis of interaction of the receiver coil with the magnetic field of the site 100. A change in the strength of the magnetic field i.e. a magnetic signal induces electric current in the receiver coil. The receiver coil converts magnetic signals of audio frequency into electric current of audio frequency. In the hearing aid, the current signal is converted back into audible sound by a loud speaker. In the mapping system, the audio frequency electric signal may be stored in a local database 110. The local database 110 may be a memory of the sensor unit 106. Alternatively, the local database 110 may be a memory separate from the sensor unit 106 and the sensor unit 106 may transmit the detected audio frequency signal to the local database 110 wirelessly or via a wire.

The sensor unit 106 comprises a position sensor 112 which receives a signal carrying position related data from the site 100. The signal and data may be filtered when received. The position related data may also be stored in the local database 110 in a similar manner to the audio frequency signal. The detected audio frequency signal and the position data are associated with each other. The association may be based on common timing of the reception of the magnetic signal and the position data or on a common order of samples of the magnetic signal and the position data, for example. In any case, for all audio frequency signal detections it is known where they have been detected in the site 100. A sample of the magnetic transmission at each measured position may have duration of about 0.1 seconds to a few seconds. However, the duration of the sample may be any length found useful.

The sensor unit 106 may comprise a user interface which may comprise a presentation device 114 which shows the detected audio frequency signal and/or the position of the sensor unit 106. The results may be shown in real time or as play-back. The user interface may also have a keyboard for inputting information to the sensor unit 106. The keyboard may, however, be realized as a touch sensitive display such as a touchscreen which shows the keys to the user and detects and responds to the key which is touched on the screen. Furthermore, the user interface may comprise a loudspeaker for producing sound from the audio frequency signal.

In an embodiment, the sensor unit 106 may be moved at the site 100 so that a map of the site 100 can be formed on the basis of the positioning data alone. For example, the outer borders of the site 100 may be measured and a plurality of points inside the borders. A pole or any other limiting structure may be determined by position measurements and such a structure may be shown in a site map and in a quality map (see FIG. 4). The user of the sensor unit 106 may input data through the interface about objects at their positions. Corners of a table and chairs may be marked in such a manner, for example.

In an embodiment, the sensor unit 106 may additionally comprise at least one microphone 109 which may receive audio signals at different positions at the site 100. The reception of audio signals enables a measurement of audio noise as a function of place at the measurement site 100.

In an embodiment, the sensor unit 106 may comprise at least one illumination detector 107 which may detect illumination at different positions at the site 100. The illumination detector 107 may be a transducer which converts optical power to electric power. The illumination detector 107 may comprise at least one semiconductor component such as a photodiode.

The mapping system comprises a processing unit 116 which is operationally coupled with the sensor unit 106. The processing unit 116 may be a physical part of the sensor unit 106 or the processing unit 116 and the sensor unit 106 may be separate from each other. The processing unit 116 receives the audio frequency signal and the positioning data from the sensor unit 106. The processing unit 116 may receive digital signals or analog signals, which may be converted to digital ones for performing the signal processing.

In an embodiment, the sensor unit 106 may feed the audio frequency signal and the positioning data directly to the processing unit 116.

In an embodiment, the audio frequency signal and the positioning data may be fed to the processing unit 116 from the local database 110 to the processing unit 116.

In an embodiment, the audio frequency signal and the positioning data may be sent to a database server 118. The database server 118 may be a server according to a client-server model or a master-slave, model for example. Data stored in the database server 118 may be retrieved by the processing unit 116.

The processing unit 116 determines parameter values of at least one parameter of the audio frequency signal which is based on the magnetic transmission. The magnetic transmission may comprise the test signal and/or disturbance. The processing unit 116 also forms positions of the sensor unit 106 on the basis of positioning data. The positions define the places where the audio frequency signals were detected. The processing unit 116 associates the positions and values of the at least one parameter together. The processing unit 116 then forms a quality map which graphically shows the distribution associated with the parameter values with respect to positions on the site 100 and outputs said quality map. The processing unit may output said quality map to make it available to electric devices of persons requiring it. The processing unit may output said quality map directly to the electric devices or to a quality map database 128 where it is accessible by the electric devices. The database 128 may be a CRM (Customer Relationship Management) database.

In an embodiment, the processing unit 116 may form a map of the site 100 on the basis of the positions of the sensor unit 106 in the site 100. Additionally, the processing unit 116 may use other information input by the user of the sensor unit 106 in order tom form the site map. The processing unit 116 may form the quality map 134 on the basis of the site map by adding the parameter values over the site map in a graphical or alphabetical form. Alternatively, the site map may be electrically available from other sources.

The processing unit 116 may determine at least one audio noise parameter on the basis of signals received from the at least one microphone 109 and associate positions and the at least one noise parameter together. The processing unit 116 may form an audio quality map which graphically shows a distribution associated with the at least one audio noise parameter with respect to positions on the site 100. The processing unit may output said audio quality map directly to persons needing it or to the quality map database 128. Noise information helps a person with a hearing aid to avoid areas with large amounts of background noise in the site 100, for example, which in turn makes it easier to recognize the audio output of the hearing aid.

The processing unit 116 may determine at least one illumination parameter of the illumination and associate positions and the at least one illumination parameter together. The processing unit 116 may form an illumination quality map which graphically shows a distribution associated with the at least one illumination parameter with respect to positions on the site 100. The processing unit may output said illumination quality map directly to persons needing it or to a quality map database 128. Good illumination which may be provided at a stage or directed to the performer(s) on the basis of this measurement helps a person with a hearing aid to see the lips of a speaking person, for example, which in turn makes it easier to understand the words.

The processing unit 116 may comprise at least one processor and one or more memories and execute the signal processing in accordance with at least one appropriate computer program code. The processing unit 116 may perform, in block 120, an integral transform such as an FFT (Fast Fourier Transform) to the audio frequency signal received by the pick-up coil of the sensor unit 106. The FFT expresses strength of the audio frequency signal as a function of frequency. A similar transform may also be performed to the audio signal received by the at least one microphone of the sensor unit 106.

The processing unit 116 then computes, in block 122, at least one parameter from the transformed audio frequency signal or directly from the audio frequency signal. The parameters may include a frequency response, distortion, noise, signal-noise-ratio, reverberation time or the like.

By forming an FFT of the audio frequency signal, it is possible to determine whether any parameter of the audio frequency signal is below a proper level. The proper level may depend on what is defined in the induction loop performance standard IEC60118-4 2006, for example.

According to a field test of the standard 1 kHz sine wave should result in strength 400 mA/m RMS with variation of ±3 dB, for example. The frequency response should be flat (field strength variation equal to or less than ±3 dB from 100 Hz to 5 kHz). Background noise should be less than 47 dB (or 32 dB).

In an embodiment, the processing unit 116 may determine at least one multitone parameter of the magnetic transmission. As to multitone parameter, the processing unit 116 may determine strengths of ten separate audio frequencies, for example. The number of frequencies may also be more or less than ten. The processing unit 116 may determine frequency response, distortion, noise, signal-to-noise-ratio, reverberation time or the like at ten separate audio frequencies, for example.

For a map, a representative parameter is formed in the block 124 of the signal processing unit 116. The representative parameter may be selected from the one or more parameters or the representative parameter may be a combination the one or more parameters. The representative parameter may be a function of the one or more parameters.

The processing unit 116 forms, in the block 126, a quality map which presents the representative parameter as a function of position in the site 100. The quality map may be understood as a coverage map which defines how well an audio frequency signal which is transmitted through magnetic coupling can be heard in different places of the site 100. The audio quality map may show similar features of the audio signals.

In an embodiment, the parameter map may be fed to the user interface 114 of the sensor unit 106 on the display of which the quality map may be shown to the user.

The quality map database 128 stores the quality map which was formed. The quality map database 128 is capable of storing a plurality of quality maps. The quality map database 128 may be a server according to a client-server model or a master-slave, model for example. The quality map database 128 may have connection to a data network 130 such as the Internet. The quality maps stored in the quality map database server 128 may be retrieved through the data network 130 by a user. Then the user of terminal equipment 132 may see the quality map 134 of the site 100 or any site available on the display of the terminal equipment 132 which has connection to the data network 130. The quality map refers to at least one map formed on the basis of a magnetic signal, an audio signal and/or illumination.

In an embodiment, the service provider may protect the quality maps related to magnetic and audio signals and illumination such that any user of a terminal equipment 132 may enter the page of the quality maps and each quality map can freely be seen on a display of a terminal equipment 132 after the owner of the site 100 has paid an agreed sum of money related to the quality mapping of the site 100. In this manner, the mapping system may allow the terminal equipment 132 of a user to contact or have connection to the quality map database 128 for showing the at least one quality map on a display of his/her terminal equipment. The availability of each quality map may be restricted such that the quality map may be seen on the display only if the user passes a validity test of the mapping system. The validity test may be determined by the service provider. The user identification code and the password may be given by the service provider.

Figure 2:
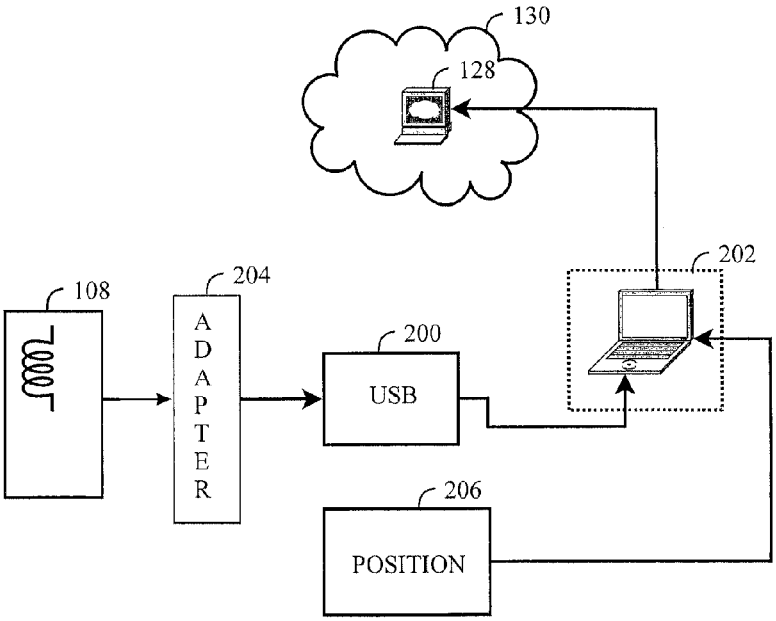

FIG. 2 illustrates the mapping system more closely. In an embodiment, the measurement receiver 108 of the sensor unit 106 may be coupled to a sound card 200 with a USB (Universal Serial Bus) coupler. The sound card 200 may have a connection to a computer such as a PC (Personal Computer) 202 which may comprise the processing unit 116.

In an embodiment, an adapter 204 may be used between the measurement receiver 108 and the sound card 200. The adapter 204 may be an attenuator or an amplifier, for example.

In an embodiment, the determination of a position of the sensor unit 106 with the measurement receiver 108 during measurement of magnetic audio frequency signals in the site 100 may be based on the High Accuracy Indoor Positioning (HAIP™) technology or the like, for example, which is shown in block 206. The position data of the sensor unit 106 may be fed to the computer 202.

The computer 202 may form a quality map of a magnetic or audio signal on the basis of the positioning data and the audio frequency signal. The computer 202 may send the quality map data to a server 128 through a data network 130 (an alternative to what is shown in FIG. 1). The quality map may be retrieved by users through the data network 130. The server 128 uses a server program which may allow an access to a certain quality map(s) on the basis of certain grounds. The grounds may be decided by the service provider. The quality map of illumination may be formed in a similar manner.

Figure 3:
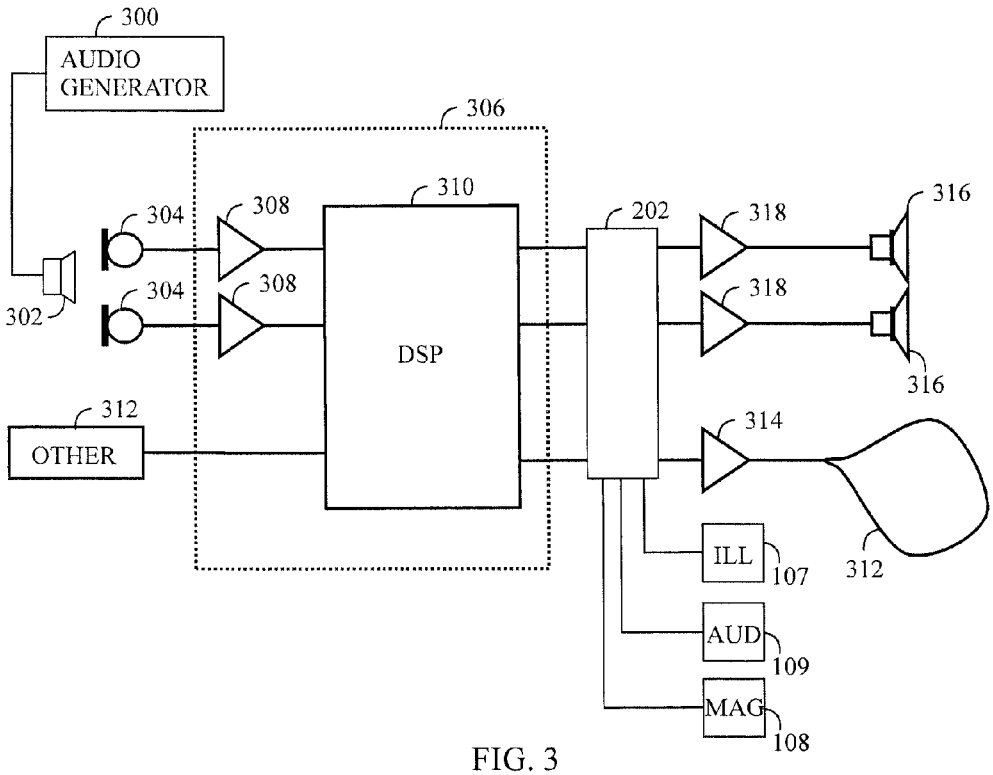
FIG. 3 illustrates an example of an audio frequency induction loop-system.

FIG. 3 presents an example of the AFILS system. A test signal may be generated with an acoustic audio generator 300 and at least one loudspeaker 302. The test signal may or may not have a multitone, MLS (Maximum Length Sequence) or sine waveform, for example. The test signal may also be based on voice of a person talking or singing to the at least one microphone 304. The acoustic audio generator 300 may generate artificial voice or it may retrieve a voice signal from memory. The voice may fulfil the recommendation ITU-T P.50, for example. Alternatively or additionally, the sound output by the acoustic audio generator 300 may fulfil recommendation ITU-T P501 which refers to use of technical signals which may be pure or distorted sine waves and speech-like signals. Tests based on other ITU-T P series or different principles may also be used. The at least one microphone 304 of the AFILS system may receive the sound or voice from the loudspeaker 302 or from the person and convert the sound and/or voice to an electrical signal. The distance between the loudspeaker 302 or the person and the microphone 304 may be predetermined. The distance may be about 1 m, for example. A front stage 306 may comprise an amplifier 308 and/or an audio signal processor 310 for processing the electrical signal coming from the at least one microphone 304. The front stage 306 may also receive electrical signals from other sources 312 such as a CD-player (Compact Disc), a DVD-player (Digital Versatile Disc or Digital Video Disc), a radio, a TV or the like, for example. The front stage 306 may output the electrical signal to the computer 202. The computer 202 may eliminate certain disturbances from the electrical signal. The disturbances may be a sudden clap of hands of a person near the microphone 304, a bang (of a door), sirens of emergency vehicles, or the like. Then the electrical signal may be fed to an AFILS loop 312 for transmitting the sound and/or voice as a magnetic signal. Between the computer 202 and the loop 312 there may be an adapter 314 which may be an amplifier. The mobile sensor unit 106 of the mapping system then receives magnetic audio frequency transmission for mapping the signal quality at the site 100.

In an embodiment, the audio frequency signal from the computer 202 may additionally be fed to at least one loudspeaker 316 at the site 100. The at least one loudspeaker 316 may output an audio signal to the site 100. The microphone 109 of the mobile sensor unit 106 may then receive the audio signal and feed it further to analysis process. The coverage of the audio signal may be determined in a similar manner to that of the magnetically transmitted audio frequency signal.

Figure 4:
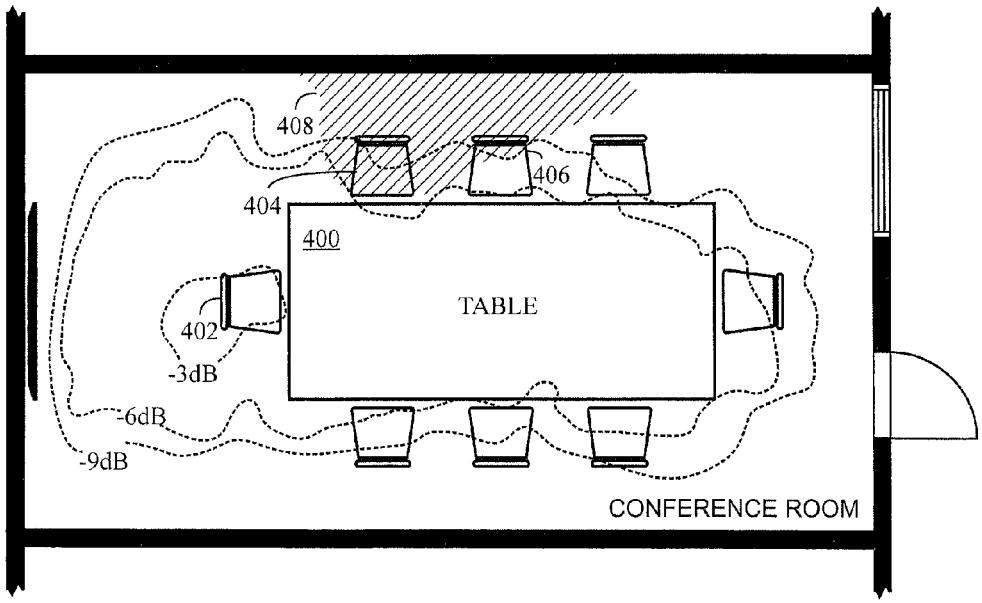
FIG. 4 illustrates an example of quality map.

FIG. 4 illustrates a quality map of a site which is a conference room in this example. The parameter in this example is the strength of the magnetic audio frequency signal. The best signal strength is at a seat 402 of one head of the table 400 because the −3 dB curve practically surrounds the seat 402. Other seats are at least nearly between −6 dB and −9 dB curves.

The seats 404 and 406 suffer from disturbance 408. The seat 404 suffers from it severely and the seat 404 should be avoided by a person with a hearing aid. In the prior art, a person with a hearing aid wouldn't have had access to the information of the disturbance even if the disturbance were measured. That is why users of a hearing aid have had difficulties in the situations when they have seated in a place having poor magnetic signal quality. On the other hand, the disturbance has not been measured in the prior art. The magnetic disturbance may come from wires of the electric network i.e. from the mains. The frequency of the disturbance is typically 50 Hz which is an audio frequency because that is a typical frequency of the electric network. However, the frequency may be different such as 60 Hz, for example. The disturbance may be caused by stray earth currents which may be due to a poor earthing, for example. Near railway networks and stations the problem may appear, for example. However, irrespective of the reason of the magnetic audio frequency disturbance, it can be detected and localized with the mapping system. A person with a hearing aid may check the quality map stored in the quality map database 128 before entering or during staying in the conference room, for example. In that manner, he/she can find a place where he/she can hear audio signal in a best possible way or at least with a good enough quality.

Figure 5:
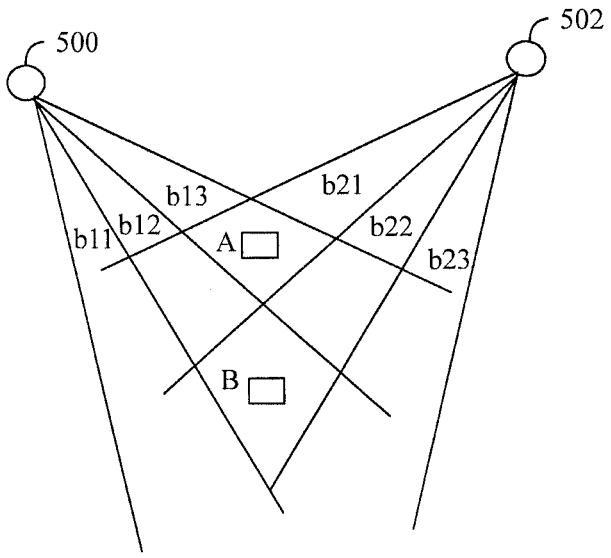
FIG. 5 illustrates an example of a positioning system.

FIG. 5 presents an example of positioning principle. A positioning transmitter 500 may transmit different beams to different angles or directions at a site. The information of the beams may comprise the transmission direction or angle of the beams. Another transmitter 502 may operate in a similar manner. Thus, the mobile sensor unit 106 in position A may receive information related to a beam b13 from the transmitter 500 and a beam b21 from the transmitter 502. When the mobile sensor unit 106 is position B the mobile sensor unit 106 may receive information related to beams b12 and b22. When the positions of transmitters 500, 502 and the transmission directions of the beams are determined the position of the sensor unit 106 may be determined on the basis of information related to the beams and positions of the transmitters. In general, the number of transmitters may be at least two.

Another positioning system may be based on triangulation. When three or more transmitters at different locations transmit beams, the receiver may determine its position on the basis of time of flight between the receiver and the transmitters. The time of flight determine the distance from each transmitter which can be represented as a circle around the transmitters. The three or more circles have only one crossing point which is the position of the receiver. The person skilled in the art knows a plurality of positioning systems, per se, to measure a position of the sensor unit 106 at the site.

Still another positioning system may be based on magnitude or direction of earth's magnetic field affected by the local structures of the site 100. Magnetometers may detect anomalies in earth's magnetic field which are caused by steel beams or other metallic structures of the site 100. The magnetic field with its anomalies is different at each place at the site which creates a unique magnetic signature for each position of the sensor unit 106. By comparing the measured field with a known magnetic field at the site 100 it is possible to determine the position of the sensor unit 106.

In an embodiment, the processing unit 116 may form three-dimensional positions of the sensor unit 106 on the basis of positioning data and form a three-dimensional quality map 134 graphically showing a distribution associated with the at least one parameter with respect to positions on the site 100. Then the processing unit 116 may output said three-dimensional quality map 134 for a person requiring it or to the quality map database 128.

Figure 6:
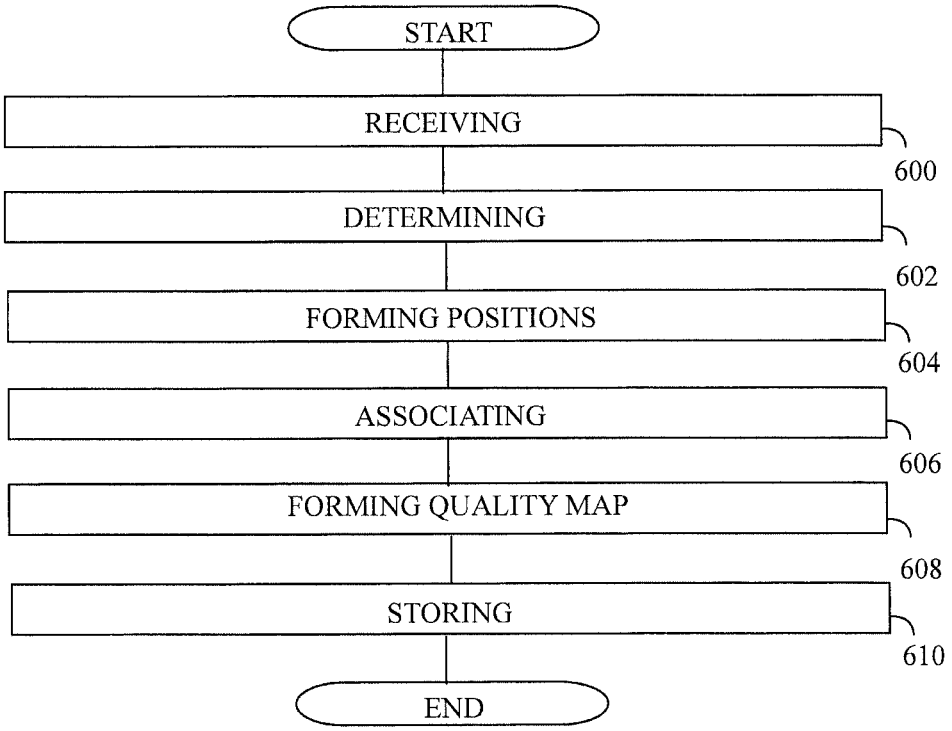
FIG. 6 illustrates an example of a flow chart of the mapping method.

FIG. 6 shows a flow chart of the method. In step 600, magnetic audio frequency transmission from a site 100 to be mapped and positioning data with respect to the site 100 to be mapped are received by a sensor unit 106 which is mobile. In step 602, at least one parameter of the magnetic transmission is determined. In step 604, positions of the sensor unit (106) on the basis of positioning data are formed. In step 606, positions and the at least one parameter are associated together. In step 608, a quality map 134 graphically showing a distribution associated with the at least one parameter with respect to positions on the site 100 is formed. In step 610, said quality map 134 is stored in a quality map database 128 for making it electrically available to a user of the site 100.

The method shown in FIG. 6 may be implemented as at least one logic circuit solution or computer program. The at least one computer program may be placed on a computer program distribution means for the distribution thereof. The computer program distribution means is readable by at least one data processing device for encoding the computer program commands and carrying out the actions.

The distribution medium, in turn, may be a medium readable by a data processing device, a program storage medium, a memory readable by a data processing device, a software distribution package readable by a data processing device, a signal readable by a data processing device, a telecommunications signal readable by a data processing device, or a compressed software package readable by a data processing device.

It will be obvious to a person skilled in the art that, as the technology advances, the inventive concept can be implemented in various ways. The invention and its embodiments are not limited to the examples described above but may vary within the scope of the claims.

What is claimed is:

1. A mapping system, wherein the mapping system comprises a sensor unit which is mobile and is configured to receive magnetic audio frequency transmission from a site to be mapped and positioning data with respect to the site to be mapped;

a processing unit which is operationally coupled with the sensor unit and which is configured to determine at least one parameter of the magnetic transmission, form positions of the sensor unit on the basis of the positioning data, associate the positions and the at least one parameter together, form a quality map graphically showing a distribution associated with the at least one parameter with respect to the positions on the site and output said quality map.

2. The mapping system as claimed in claim 1, wherein the mapping system comprises a quality map database which is configured to receive the quality map and store said quality map; and the quality map database is configured to allow an electric device of a user to contact the database and show the quality map on a screen of his/her electric device.

3. The mapping system as claimed in claim 1, wherein the mapping system comprises at least one positioning transmitter at the site, the at least one positioning transmitter being configured to transmit the positioning data on the basis of which the processing unit is configured to determine different positions of the sensor unit; and the site has an audio frequency induction loop-system which is configured to provide the site with magnetic audio frequency transmission.

4. The mapping system as claimed in claim 1, wherein the processing unit is configured to determine at least one multitone parameter of the magnetic transmission.

5. The mapping system as claimed in claim 1, wherein the processing unit is configured to form a representative parameter of the at least one parameter for the quality map; and the parameter, from which the representative parameter is formed, is one of the following: a frequency response, distortion, noise, a signal-to-noise-ratio, reverberation time.

6. The mapping system as claimed in claim 1, wherein the processing unit is configured to form a site map on the basis of the positions of the sensor unit in the site; and the processing unit is configured to form the quality map on the basis of the site map.

7. The mapping system as claimed in claim 1, wherein the sensor unit comprises at least one microphone for detecting audio signals at different positions at the site; and the processing unit is configured to determine at least one audio signal parameter of the audio signals, associate the positions and the at least one audio signal parameter together, form an audio signal quality map graphically showing a distribution associated with the at least one audio signal parameter with respect to the positions on the site and output said audio signal quality map.

8. The mapping system as claimed in claim 1, wherein the sensor unit comprises at least one illumination detector for detecting illumination at different positions at the site; and the processing unit is configured to determine at least one illumination parameter of the illumination, associate the positions and the at least one illumination parameter together, form an illumination quality map graphically showing a distribution associated with the at least one illumination parameter with respect to the positions on the site and output said illumination quality map.

9. The mapping system as claimed in claim 1, wherein the processing unit form three-dimensional positions of the sensor unit on the basis of the positioning data, form a three-dimensional quality map graphically showing a distribution associated with the at least one parameter with respect to the positions on the site and output said three-dimensional quality map.

10. A mapping method, the method comprising:

receiving, by a sensor unit which is mobile, magnetic audio frequency transmission from a site to be mapped and positioning data with respect to the site to be mapped;

determining at least one parameter of the magnetic transmission;

forming positions of the sensor unit on the basis of the positioning data;

associating the positions and the at least one parameter together;

forming a quality map graphically showing a distribution associated with the at least one parameter with respect to the positions on the site;

storing said quality map in a quality map database for making it electrically available to a user of the site.

* * * * *